US012560037B1

(12) United States Patent
Rahman et al.

(10) Patent No.: US 12,560,037 B1
(45) Date of Patent: Feb. 24, 2026

(54) METHOD OF PREPARING DRILLING MUD THROUGH INTEGRATING ULTRASONIC MIXING AND VENTURI TECHNOLOGY

(71) Applicant: Baker Hughes Oilfield Operations LLC, Houston, TX (US)

(72) Inventors: Syed Ehsanur Rahman, Conroe, TX (US); Reza Ettehadi Osgouei, Spring, TX (US); Robert Banker Comer, Spring, TX (US); Emery Horton, Houston, TX (US)

( * ) Notice: Subject to any disclaimer, the term of this patent is extended or adjusted under 35 U.S.C. 154(b) by 0 days.

(21) Appl. No.: 18/811,351

(22) Filed: Aug. 21, 2024

(51) Int. Cl.
*E21B 21/06* (2006.01)

(52) U.S. Cl.
CPC ..... *E21B 21/062* (2013.01); *E21B 21/068* (2013.01)

(58) Field of Classification Search
CPC ..... E21B 21/06; E21B 21/062; E21B 21/068
USPC ..... 175/66
See application file for complete search history.

(56) References Cited

U.S. PATENT DOCUMENTS 10,661,236 B2 * 5/2020 Noui-Mehidi ..... B01F 25/50
2008/0049544 A1 * 2/2008 Bingham ..... B01F 23/45 366/101
2009/0023614 A1 * 1/2009 Sullivan ..... B01F 23/81 507/214
2009/0154288 A1 * 6/2009 Heathman ..... B01F 25/51 366/181.8
2011/0290492 A1 * 12/2011 Hodgson ..... C09K 8/72 366/132
2019/0106614 A1 * 4/2019 Sharma ..... C09K 8/36
2019/0226336 A1 7/2019 Benson et al.
2020/0061553 A1 2/2020 Cobb
2020/0123429 A1 * 4/2020 Offenbacher ..... C09K 8/36
2020/0208476 A1 * 7/2020 Kapila ..... E21B 21/063
2021/0404270 A1 12/2021 May et al.
2022/0363972 A1 11/2022 Jones et al.

OTHER PUBLICATIONS

Notification of Transmittal of the International Search Report and the Written Opinion of the International Searching Authority, or the Declaration; PCT/US2025/042541; Mail date: Dec. 19, 2025; 10 pages.

* cited by examiner

*Primary Examiner* — Angela M DiTrani Leff
(74) *Attorney, Agent, or Firm* — Baker Hughes Company

(57) ABSTRACT

A process includes pumping a first fluid into a conduit; introducing a second fluid into a flow of the first fluid in the conduit via a venturi injector to mix the first fluid with the second fluid forming a premix; adding an additive to the premix forming an additive-containing fluid; and passing the additive-containing fluid through an ultrasonicator forming a drilling mud comprising an emulsion, in which the first fluid forms a continuous phase and the second fluid forms a discontinuous phase.

20 Claims, 2 Drawing Sheets

METHOD OF PREPARING DRILLING MUD THROUGH INTEGRATING ULTRASONIC MIXING AND VENTURI TECHNOLOGY

BACKGROUND

This disclosure relates to methods of building drilling muds. Drilling muds are fluids that can aid the drilling of boreholes into a subterranean formation. Drilling muds perform a number of functions as it circulates through the wellbore including cooling and lubricating the drill bit, removing drill cuttings from the wellbore, aiding in support of the drill pipe and drill bit, minimizing formation damage, stabilizing wellbore, and providing a hydrostatic head to maintain the integrity of the wellbore walls and prevent well blowouts. Drilling muds can also prevent sloughing and wellbore cave-ins when drilling through water sensitive formations.

Traditional methods of creating drilling muds require a dedicated facility where a shearing device is used. The shearing device can be energy consuming, expensive, and it can also create heat waste. Accordingly, there is a continuing need for an alternative method to prepare a drilling mud.

BRIEF DESCRIPTION

A process includes: pumping a first fluid into a conduit; introducing a second fluid into a flow of the first fluid in the conduit via a venturi injector to mix the first fluid with the second fluid forming a premix; adding an additive to the premix forming an additive-containing fluid; and passing the additive-containing fluid through an ultrasonicator forming a drilling mud comprising an emulsion, in which the first fluid forms a continuous phase and the second fluid forms a discontinuous phase.

A system for preparing a drilling mud includes a conduit having a first inlet for receiving a first fluid, and a second inlet located downstream of the first inlet for receiving a second fluid, the second inlet comprising a venturi injector where the second fluid is mixed with a flow of the first fluid forming a premix; a hopper coupled to the conduit and configured to allow an additive to be added to the premix in the conduit forming an additive-containing fluid; an ultrasonicator that receives the additive-containing fluid and after ultrasonic mixing, generates a drilling mud comprising an emulsion in which the first fluid forms a continuous phase, and the second fluid forms a discontinuous phase; a fluid measurement system configured to measure a property of the drilling mud generated from the ultrasonicator, and a processing device configured to process information received from the fluid measurement system, and to control an adjustment of the property of the drilling mud.

BRIEF DESCRIPTION OF THE DRAWINGS

The following descriptions should not be considered limiting in any way. With reference to the accompanying drawings, like elements are numbered alike.

DETAILED DESCRIPTION

A process of preparing a drilling mud is disclosed. The process integrates ultrasonic mixing, the venturi effect, and a control system featuring machine learning algorithms. The process can be implemented at liquid mud plants and rig sites and can be scaled to many different sizes suitable for any mud mixing application. The use of the combined technology can decrease mixing time, reduce chemical wasting, reduce energy consumption, and improve the emulsion stability. The process also provides an in-line solution, although it can also be a discontinuous process if needed. Moreover, the emulsion created by the process can achieve the desired physical and chemical properties and can be more stable than the emulsions prepared by the shearing devices and traditional mixing blenders.

As used herein, a drilling mud includes a drill-in fluid, as the drill-in fluid is a type of drilling fluid designated especially for drilling through the reservoir section of a wellbore. An emulsion can include an oil-in-water emulsion, or a water-in-oil emulsion. An oil-in-water emulsion comprises a continuous or external aqueous phase and a discontinuous or internal oil phase. A water-in-oil emulsion comprises a continuous or external oil phase and a discontinuous or internal aqueous phase. A water-in-oil emulsion can also be referred to as an invert emulsion. Solid particles in the drilling mud can suspend in the aqueous phase, the oil phase, or both phases of an emulsion.

A drilling mud can be prepared from a first fluid, a second fluid, and an additive that comprises solids. If the first fluid is a polar fluid, then the second fluid is a non-polar fluid. Similarly, if the first fluid is a non-polar fluid, then the second fluid is a polar fluid. A polar fluid can include water or a brine. A non-polar fluid can include an oil such as a diesel oil, a paraffin oil, a vegetable oil, a soybean oil, a mineral oil, a crude oil, a gas oil, kerosene, an aliphatic solvent, an aromatic solvent, a synthetic oil, or a combination comprising at least one of the foregoing.

A process of preparing a drilling mud comprises pumping a first fluid into a conduit, and introducing a second fluid into a flow of the first fluid in the conduit via a venturi injector to premix the first fluid with the second fluid.

Figure 2:
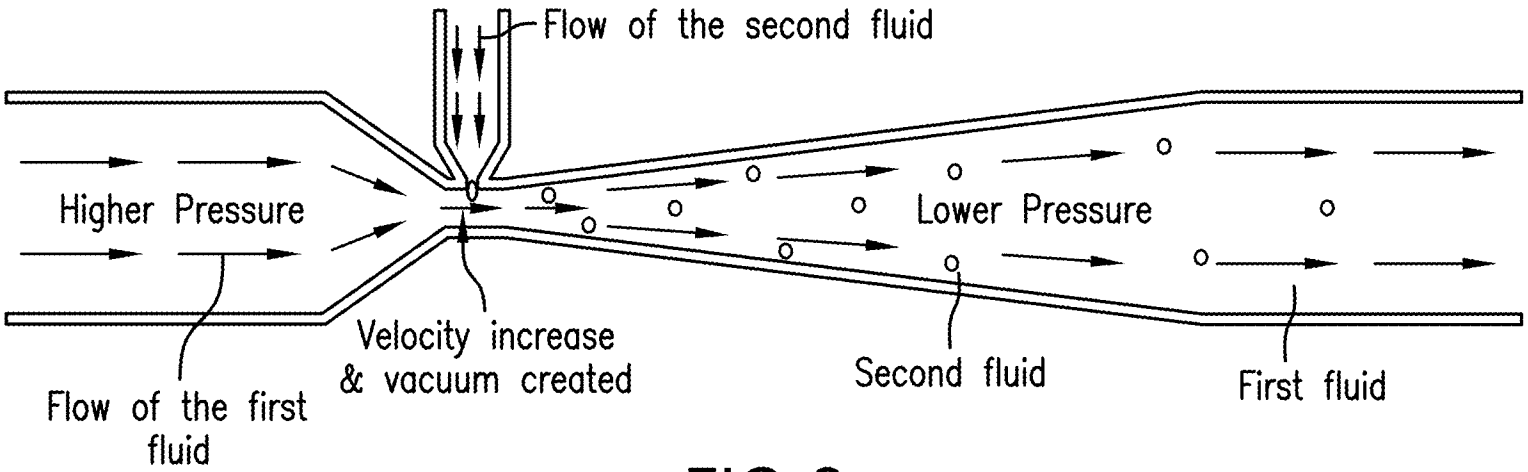
FIG. 2 is a diagram illustrating the venturi effect integrated into a process of preparing a drilling mud.

The venturi injector is not particularly limited as long as it can create the venturi effect. As illustrated in FIG. 2, the venturi effect is caused by decreasing a pipe diameter during the flow of a fluid. This increases the speed which causes a sudden drop in pressure and vacuum effect. The vacuum effect allows for the introduction of another fluid into the flow stream.

In the process described herein, the second fluid, which forms a discontinuous or internal phase in the finally prepared drilling mud, can be introduced (dozed) to a flow of the first fluid, which forms a continuous or external phase in the finally prepared drilling mud. This is done via a venturi injector to premix the first fluid and the second fluid thus facilitating the formation of an emulsion. With the premixing, an emulsion with the desired stability can be formed using an ultrasonicator.

If the first fluid comprises water or a brine, the second fluid comprises an oil, and the drilling mud prepared from the process as disclosed herein comprises an emulsion in which water/brine forms a continuous or external phase, and the oil forms a discontinuous or internal phase.

Preferably, the first fluid comprises an oil, and the second fluid comprises water or a brine. The drilling mud prepared from the process comprises an emulsion in which the oil forms a continuous or external phase, and water/brine forms a discontinuous or internal phase. In addition to the oil, the first fluid can also comprise an emulsifier. The emulsifiers used are the same ones typically used in water-in-oil emulsions. These include various fatty acid and derivatives thereof, polymers such as polyamides, or a combination comprising at least one of the foregoing. Exemplary fatty acid derivatives include fatty acid soaps, such as the calcium soaps, which can be prepared by reacting a fatty acid with lime. When the first fluid comprises both an oil and an emulsifier, a tank that stores the first fluid can have an agitation means such as a mixing device. This can mix the oil and the emulsifier so that the emulsifier is uniformly distributed throughout the first fluid before the first fluid is pumped into the conduit.

The amounts of the first fluid and the second fluid that are introduced to the conduit can be controlled by adjusting the controlling devices such as valves, flow meters, and pumps.

The additive can be added to the premix in the conduit via a hopper. The additive comprises solids, and the hopper can allow for the precise control of solids added through a valve. The additive can comprise at least one of a weighting agent, a viscosifier, a lost circulation material, a filler, a rheology modifier, a dispersant, a defoamer, a surfactant, an emulsifier, a pH buffer, a lubricant, a scale inhibitor, a corrosion inhibitor, a biocide, or a $H_2S$ scavenger. The additive is not particularly limited and any known additive for drilling muds can be used.

After the additive is added, the fluid in the conduit forms an additive-containing fluid, which then passes through an ultrasonicator forming a drilling mud comprising an emulsion, in which the first fluid forms a continuous or external phase, and the second fluid forms a discontinuous or internal phase, via ultrasonic mixing. Ultrasonic mixing uses high frequency vibration to form cavitations in the mud. These cavitations create shear forces that effectively break and mix the dispersed phase. The ultrasonicator has a flow cell attachment that allows for continuous flow and emulsification as the fluid passes through. The ultrasonicator is commercially available. An example of the ultrasonicator is UIP6000hdT—6 kW High-Performance Ultrasonicator available from Hielscher.

The drilling mud generated from the ultrasonicator then passes through a fluid measurement system where a property of the drilling mud is determined. The fluid measurement system can have various sensors, meters, probes, instruments, and devices for determining at least one of a rheological property, a filtration property, a density, a water/oil ratio, a solids content, a flow rate, a temperature, an emulsion stability, a conductivity, or a pH of the drilling mud. The rheological property can include gel strength, plastic viscosity, yield point, and/or apparent viscosity. Examples of the sensors and meters include fraction sensors such as electromagnetic water and solid sensors, density sensors, conductivity sensors, viscometers including but not limited to rotary and pipe viscometers, resistivity meters, pH meters, thermometers, and the like. Preferably the fluid measure system can determine the properties of the drilling mud in-line.

The properties of the drilling mud can be tested parallel or sequentially or a combination thereof. For example, the density and pH of the mud can be determined sequentially when the mud passes a density sensor and a pH meter, and meanwhile a second portion of the drilling mud can be tested for rheological properties such as gel strength.

Property assessments occur sequentially or in parallel, with real-time analysis through a connected processing device running algorithms to compare properties against criteria. If compliant, the mud moves to final storage; otherwise, it recirculates for adjustment. Adjustments involve adding property-modifying materials or tuning ultrasonicator parameters like frequency and energy output. The processing device manages these adjustments via controlling devices, ensuring continuous quality.

The system can encompass a continuous process, with real-time property monitoring and machine learning algorithms optimizing mud characteristics to meet specifications.

The property of the recirculated drilling mud can be adjusted by adding a property-modifying material to the recirculated drilling mud, or tuning an operating parameter of the ultrasonicator, or both. The property-modifying material includes at least one of the first fluid, the second fluid, an oil, water, a brine, a weighting agent, a viscosifier, a thinner, a lost circulation material, a filler, a rheology modifier, a dispersant, a defoamer, a surfactant, an emulsifier, a pH buffer, a lubricant, a scale inhibitor, a corrosion inhibitor, a biocide, or a $H_2S$ scavenger. The property-modify material can be added via the inlet for the first fluid, the inlet for the second fluid, or the hopper for the additive. The operating parameter of the ultrasonicator that can be tuned includes at least one of frequency, energy output, mixing time, or a temperature in a mixing chamber of the ultrasonicator.

The processing device can control the adjustment of the mud properties via a first fluid controlling device, a second fluid controlling device, and the additive controlling device coupled to the processing device. These controlling devices include metering pumps or valves. For example, the processing device can open and close valves so that a target amount of the property-modifying material can be added to the recirculated drilling mud. The processing device is also coupled to the ultrasonicator to vary the operating parameters of the ultrasonication.

Advantageously, the process is a continuous process. In the process, the drilling mud is continuously generated from the first fluid, the second fluid, and the additive via the venturi injector and the ultrasonication, and the properties of the drilling mud is monitored via a fluid measurement system. A processing device receives and analyze the real time fluid properties and controls an adjustment of the properties of the drilling mud until the desired specification or readings are met.

Figure 1:
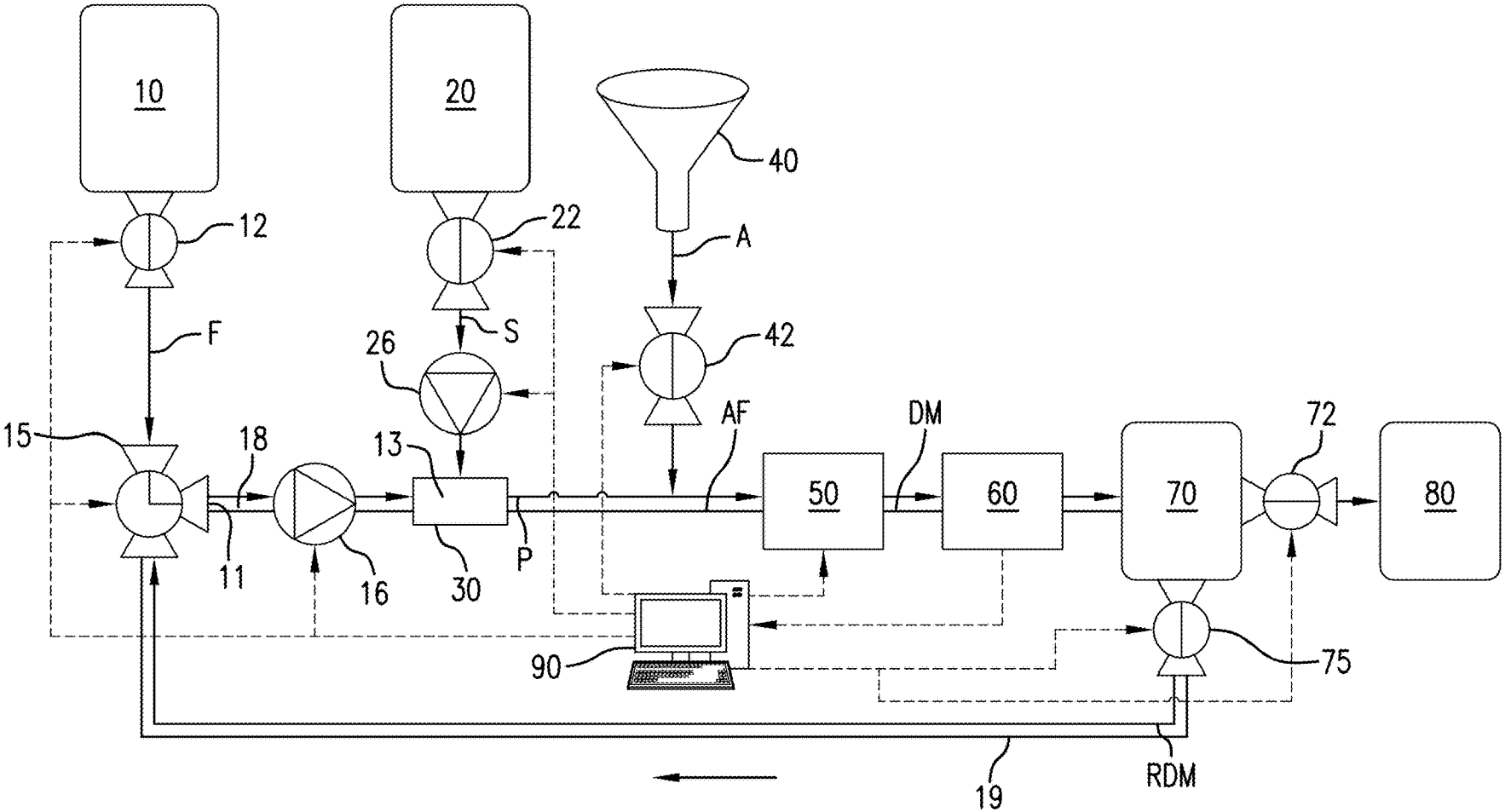
FIG. 1 is a diagram illustrating a system and process for preparing a drilling mud.

FIG. 1 is a diagram illustrating a system and process for preparing a drilling mud. The system includes a conduit (18) having a three-way valve (11) for receiving a first fluid (F), and a second inlet (13) located downstream of the three-way valve (11) for receiving a second fluid(S). The first fluid (F) can be stored in a tank (10) before being pumped into the conduit (18) via a first fluid control device which can include at least a valve (12), a three-way valve (15), or a pump (16). The three-way valve (15) can also control which fluid (first fluid, recirculated drilling mud, or both) can be added to the conduit (18).

The second inlet (13) comprises a venturi injector (30) where the second fluid(S) is mixed with a flow of the first fluid (F) forming a premix (P). The second fluid(S) can also be stored in a storage tank (20) before being introduced to the conduit (18) via a second fluid control device which can include at least one of a valve (22) or a pump (26).

The system also comprises a hopper (40) coupled to the conduit (18) and configured to allow an additive (A) to be added to the premix (P) in the conduit (18) optionally via an additive control device (42). The additive (A) together with the premix (P) form an additive-containing fluid (AF) in the conduit (18).

The ultrasonicator (50) in the system receives the additive-containing fluid (AF) in the conduit (18). After ultrasonic mixing, the additive-containing fluid forms a drilling mud (DM) comprising an emulsion.

The ultrasonicator (50) is in communication with a fluid measurement system (60), which is configured to measure a property of the drilling mud (DM). The drilling mud (DM) generated from the ultrasonicator (50) can be stored in an intermediate tank (70) if needed.

The information from the fluid measurement system (60) can be received and process at a processing device (90) in the system. The processing device (90) is electrically connected to pumps (16, 26), valves (12, 15, 22, 26, 72, 75), ultrasonicator (50) and the fluid measurement system (60), and can control the adjustment of mud properties. The processing device (90) can recirculate the drilling mud (RDM) to the conduit (18) via a second conduit (19) at a location where the first fluid (F), the second fluid(S), and the additive (A) can be added to the recirculated drilling mud (RDM) if needed. If the drilling mud (DM) has the target properties, the drilling mud can be transferred, for example via a valve (72) to a final tank (80) for storage.

Set forth below are various embodiments of the disclosure.

Embodiment 1. A process comprising: pumping a first fluid into a conduit; introducing a second fluid into a flow of the first fluid in the conduit via a venturi injector to mix the first fluid with the second fluid forming a premix; adding an additive to the premix forming an additive-containing fluid; and passing the additive-containing fluid through an ultrasonicator forming a drilling mud comprising an emulsion, in which the first fluid forms a continuous phase and the second fluid forms a discontinuous phase.

Embodiment 2. The process as in any prior embodiment, further comprising incorporating a control system using machine learning algorithms to analyze sensor data in real-time, adjusting process parameters including at least one of additive injection, pump pressure, or ultrasonic mixing frequency or amplitude to achieve target mud properties.

Embodiment 3. The process as in any prior embodiment, wherein the first fluid comprises an oil, and the second fluid comprises water or a brine.

Embodiment 4. The process as in any prior embodiment, wherein the first fluid further comprises an emulsifier.

Embodiment 5. The process as in any prior embodiment further comprising mixing the oil and the emulsifier before pumping the first fluid into the conduit.

Embodiment 6. The process as in any prior embodiment, wherein the first fluid comprises water or a brine, and the second fluid comprises an oil.

Embodiment 7. The process as in any prior embodiment, wherein the additive comprises at least one of a weighting agent, a viscosifier, a thinner, a lost circulation material, a filler, a rheology modifier, a dispersant, a defoamer, a surfactant, an emulsifier, a pH buffer, a lubricant, a scale inhibitor, a corrosion inhibitor, a biocide, or a $H_2S$ scavenger.

Embodiment 8. The process as in any prior embodiment, wherein the additive comprises solids.

Embodiment 9. The process as in any prior embodiment, further comprising determining a property of the drilling mud, the property comprising at least one of a rheological property, a filtration property, a density, a water/oil ratio, a solids content, a flow rate, a temperature, an emulsion stability, a conductivity, or a pH of the drilling mud.

Embodiment 10. The process as in any prior embodiment, wherein the property of the drilling mud is determined in-line by a fluid measurement system in fluid communication with the ultrasonicator.

Embodiment 11. The process as in any prior embodiment, further comprising storing the drilling mud at an intermediate tank.

Embodiment 12. The process as in any prior embodiment, further comprising comparing the determined property with a target property, and removing the drilling mud from the intermediate tank for storage or use when the measured property meets the target property.

Embodiment 13. The process as in any prior embodiment, further comprising recirculating the drilling mud to the conduit at a location that allows the first fluid, the second fluid, and the additive to be added to the recirculated drilling mud if needed; and adjusting the property of the recirculated drilling mud by at least one of adding a property-modifying material to the recirculated drilling mud, or tuning an operating parameter of the ultrasonicator.

Embodiment 14. The process as in any prior embodiment, wherein the property of the recirculated drilling mud is adjusted by adding the property-modifying material to the recirculated drilling mud, and the property-modifying material comprises at least one of the first fluid, the second fluid, an oil, water, a brine, a weighting agent, a viscosifier, a thinner, a lost circulation material, a filler, a rheology modifier, a dispersant, a defoamer, a surfactant, an emulsifier, a pH buffer, a lubricant, a scale inhibitor, a corrosion inhibitor, a biocide, or a $H_2S$ scavenger.

Embodiment 15. The process as in any prior embodiment, wherein the property of the recirculated drilling mud is adjusted by tuning the operating parameter of the ultrasonicator, and the operating parameter of the ultrasonicator comprises at least one of frequency, energy output, mixing time, or a temperature in a mixing chamber of the ultrasonicator.

Embodiment 16. The process as in any prior embodiment, wherein the process is a continuous process.

Embodiment 17. A system for preparing a drilling mud, the system comprising a conduit having a first inlet for receiving a first fluid, and a second inlet located downstream of the first inlet for receiving a second fluid, the second inlet comprising a venturi injector where the second fluid is mixed with a flow of the first fluid forming a premix; a hopper coupled to the conduit and configured to allow an additive to be added to the premix in the conduit forming an additive-containing fluid; an ultrasonicator that receives the additive-containing fluid and after ultrasonic mixing, generates a drilling mud comprising an emulsion in which the first fluid forms a continuous phase, and the second fluid forms a discontinuous phase; a fluid measurement system configured to measure a property of the drilling mud generated from the ultrasonicator, and a processing device configured to process information received from the fluid measurement system, and to control an adjustment of the property of the drilling mud.

Embodiment 18. The system of as in any prior embodiment, further comprising an intermediate tank for storing the drilling mud generated from the ultrasonicator.

Embodiment 19. The system as in any prior embodiment, further comprising a second conduit for recirculating the drilling mud in the intermediate tank to the conduit at a location that allows the first fluid, the second fluid, and the additive to be added to the recirculated drilling mud if needed.

Embodiment 20. The system as in any prior embodiment, further comprising a first fluid control device, a second fluid control device, and an additive control device coupled to the processing device.

Embodiment 21. The system as in any prior embodiment, wherein the first fluid control device, the second fluid control device, and the additive control device each independently comprises a flow control valve or a metering pump.

As used herein, "combination" is inclusive of blends, mixtures, alloys, reaction products, and the like. The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or."

The term "configured" relates to one or more structural limitations of a device that are required for the device to perform the function or operation for which the device is configured. The limitations may be known in the art for a specific item, but not known in the context of or application to the invention as a whole. The limitations may be inclusive of circuit modules and software known to perform a specific function. The term "coupled" relates to being coupled directly or indirectly using an intermediate device. The terms "first" and "second" and like are used to distinguish terms and not to denote a particular order.

While typical embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

What is claimed is:

1. A process comprising:

pumping a first fluid into a conduit;

introducing a second fluid into a flow of the first fluid in the conduit via a venturi injector to mix the first fluid with the second fluid forming a premix;

adding a solid additive to the premix forming an additive-containing fluid; and passing the additive-containing fluid through an ultrasonicator forming a drilling mud comprising an emulsion, in which the first fluid forms a continuous phase and the second fluid forms a discontinuous phase.

2. The process of claim 1, further comprising incorporating a control system using machine learning algorithms to analyze sensor data in real-time, adjusting process parameters including at least one of additive injection, pump pressure, or ultrasonic mixing frequency or amplitude to achieve target mud properties.

3. The process of claim 1, wherein the first fluid comprises an oil, and the second fluid comprises water or a brine.

4. The process of claim 3, wherein the first fluid further comprises an emulsifier.

5. The process of claim 4 further comprising mixing the oil and the emulsifier before pumping the first fluid into the conduit.

6. The process of claim 1, wherein the first fluid comprises water or a brine, and the second fluid comprises an oil.

7. The process of claim 1, wherein the additive further comprises at least one of a weighting agent, a viscosifier, a thinner, a lost circulation material, a filler, a rheology modifier, a dispersant, a defoamer, a surfactant, an emulsifier, a pH buffer, a lubricant, a scale inhibitor, a corrosion inhibitor, a biocide, or a $H_2S$ scavenger.

8. The process of claim 1, further comprising determining a property of the drilling mud, the property comprising at least one of a rheological property, a filtration property, a density, a water/oil ratio, a solids content, a flow rate, a temperature, an emulsion stability, a conductivity, or a pH of the drilling mud.

9. The process of claim 8, wherein the property of the drilling mud is determined in-line by a fluid measurement system in fluid communication with the ultrasonicator.

10. The process of claim 9, further comprising:

recirculating the drilling mud to the conduit at a location that allows the first fluid, the second fluid, and the additive to be added to the recirculated drilling mud if needed; and adjusting the property of the recirculated drilling mud by at least one of adding a property-modifying material to the recirculated drilling mud, or tuning an operating parameter of the ultrasonicator.

11. The process of claim 10, wherein the property of the recirculated drilling mud is adjusted by adding the property-modifying material to the recirculated drilling mud, and the property-modifying material comprises at least one of the first fluid, the second fluid, an oil, water, a brine, a weighting agent, a viscosifier, a thinner, a lost circulation material, a filler, a rheology modifier, a dispersant, a defoamer, a surfactant, an emulsifier, a pH buffer, a lubricant, a scale inhibitor, a corrosion inhibitor, a biocide, or a $H_2S$ scavenger.

12. The process of claim 10, wherein the property of the recirculated drilling mud is adjusted by tuning the operating parameter of the ultrasonicator, and the operating parameter of the ultrasonicator comprises at least one of frequency, energy output, mixing time, or a temperature in a mixing chamber of the ultrasonicator.

13. The process of claim 8, further comprising storing the drilling mud at an intermediate tank.

14. The process of claim 13, further comprising comparing the determined property with a target property, and removing the drilling mud from the intermediate tank for storage or use when the measured property meets the target property.

15. The process of claim 1, wherein the process is a continuous process.

16. A system for preparing a drilling mud, the system comprising:

a conduit having:

a first inlet for receiving a first fluid, and a second inlet located downstream of the first inlet for receiving a second fluid, the second inlet comprising a venturi injector where the second fluid is mixed with a flow of the first fluid forming a premix;

a hopper coupled to the conduit and configured to allow a solid additive to be added to the premix in the conduit forming an additive-containing fluid;

an ultrasonicator that receives the additive-containing fluid and after ultrasonic mixing, generates a drilling mud comprising an emulsion in which the first fluid forms a continuous phase, and the second fluid forms a discontinuous phase;

a fluid measurement system configured to measure a property of the drilling mud generated from the ultrasonicator, and a processing device configured to process information received from the fluid measurement system, and to control an adjustment of the property of the drilling mud.

17. The system of claim 16, further comprising an intermediate tank for storing the drilling mud generated from the ultrasonicator.

18. The system of claim 17, further comprising a second conduit for recirculating the drilling mud in the intermediate tank to the conduit at a location that allows the first fluid, the second fluid, and the additive to be added to the recirculated drilling mud if needed.

19. The system of claim 17, further comprising a first fluid control device, a second fluid control device, and an additive control device coupled to the processing device.

20. The system of claim 19, wherein the first fluid control device, the second fluid control device, and the additive control device each independently comprises a flow control valve or a metering pump.

* * * * *